US009849673B2

(12) United States Patent
McGuinness et al.

(10) Patent No.: US 9,849,673 B2
(45) Date of Patent: Dec. 26, 2017

(54) GENERATE NON-UNIFORM ELECTRIC FIELD TO MAINTAIN PIGMENTS IN INK VEHICLE OF PRINTING FLUID IN NOZZLE REGION OF PRINTHEAD

(71) Applicant: HEWLETT-PACKARD DEVELOPMENT COMPANY, L.P., Houston, TX (US)

(72) Inventors: Nicholas Matthew Cooper McGuinness, San Diego, CA (US); Manish Giri, Corvallis, OR (US); Chantelle Elizabeth Domingue, Corvallis, OR (US); Melinda M. Valencia, Chula Vista, CA (US); Jeremy Sells, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/128,219

(22) PCT Filed: Apr. 11, 2014

(86) PCT No.: PCT/US2014/033839

§ 371 (c)(1),
(2) Date: Sep. 22, 2016

(87) PCT Pub. No.: WO2015/156820

PCT Pub. Date: Oct. 15, 2015

(65) Prior Publication Data

US 2017/0087844 A1 Mar. 30, 2017

(51) Int. Cl.
*B41J 2/14* (2006.01)

(52) U.S. Cl.
CPC ..... *B41J 2/14314* (2013.01); *B41J 2/1433* (2013.01)

(58) Field of Classification Search
CPC ..... B41J 2/06; B41J 2/14014; B41J 2/14314
See application file for complete search history.

(56) References Cited

U.S. PATENT DOCUMENTS 5,364,743 A 11/1994 O'Neill
5,896,154 A 4/1999 Mitani et al.
6,153,114 A 11/2000 Figueredo et al.
6,312,104 B1 11/2001 Stearns et al.
(Continued)

FOREIGN PATENT DOCUMENTS

KR 10-2011-0082969 A 7/2011

OTHER PUBLICATIONS

The Chemistry of Ink Jet Inks. World Scientific Publishing Co. Ptd. Ltd. Aug. 9, 2000.

(Continued)

*Primary Examiner* — Juanita D Jackson
(74) *Attorney, Agent, or Firm* — HP Inc. Patent Department

(57) ABSTRACT

A printhead includes a plurality of firing chambers, a plurality of fluid ejectors, and at least one field generating member. Each one of the firing chambers includes a nozzle region to receive printing fluid. The printing fluid includes an ink vehicle having pigments disposed therein. At least one field generating member generates a non-uniform electric field to apply forces to maintain respective pigments in the ink vehicle of the printing fluid in the nozzle region.

19 Claims, 6 Drawing Sheets

(56) References Cited

U.S. PATENT DOCUMENTS

| | | | | |
|---|---|---|---|---|
| 6,644,798 | B2 | 11/2003 | Katsuragi et al. | |
| 6,783,211 | B2 * | 8/2004 | Igaki | B41J 2/14209 347/68 |
| 7,055,937 | B2 | 6/2006 | Suzuki et al. | |
| 8,210,654 | B2 * | 7/2012 | Wei | B41J 2/14016 347/55 |
| 2004/0150694 | A1 | 8/2004 | Kim et al. | |
| 2013/0063525 | A1 | 3/2013 | Sieber | |

OTHER PUBLICATIONS

Korean Intellectual Property Office, International Search Report and Written Opinion for PCT/US2014/033839 dated Apr. 11, 2014 (12 pages).

* cited by examiner

GENERATE NON-UNIFORM ELECTRIC FIELD TO MAINTAIN PIGMENTS IN INK VEHICLE OF PRINTING FLUID IN NOZZLE REGION OF PRINTHEAD

BACKGROUND

Printing systems such as inkjet printers include printheads. The printheads include nozzles to eject printing fluid there through onto media. The printing fluid may include color pigments in an ink vehicle.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components, layers, substrates and features illustrated in the figures are chosen primarily for convenience and clarity of presentation and are not necessarily to scale. Referring to the attached figures:

DETAILED DESCRIPTION

Printing systems such as inkjet printers include printheads. The printheads include firing chambers including nozzle regions having printing fluid therein, and fluid ejectors to eject the printing fluid in the nozzle regions onto media. The printing fluid may include color pigments in an ink vehicle. Overtime, the color pigments in the ink vehicle located in the nozzle region may diffuse and move away from the nozzle region resulting in pigment ink vehicle separation. Consequently, ejection of the printing fluid in the nozzle region with a reduced amount of color pigments onto the media results in a reduction of image quality. Additionally, at times, pigment ink vehicle separation may result in solidification of the printing fluid in the nozzle region. Accordingly, the respective nozzle region may prevent the ejection of printing fluid and reduce the lifespan of a corresponding fluid ejector.

In examples, a printhead includes a plurality of firing chambers, a plurality of fluid ejectors, and at least one field generating member. Each firing chamber includes a nozzle region to receive printing fluid. The printing fluid includes an ink vehicle having pigments disposed therein. At least one field generating member generates a non-uniform electric field to apply forces to maintain respective pigments in the ink vehicle of the printing fluid in the nozzle region. Thus, the pigments in the ink vehicle located in the nozzle region may remain therein, rather than diffuse and move away from the nozzle region. Accordingly, the printing fluid ejected onto the media includes an appropriate amount of pigments. Thus, a reduction of image quality due to pigment ink vehicle separation and solidification of printing fluid in the nozzle region may be reduced.

Figure 1:
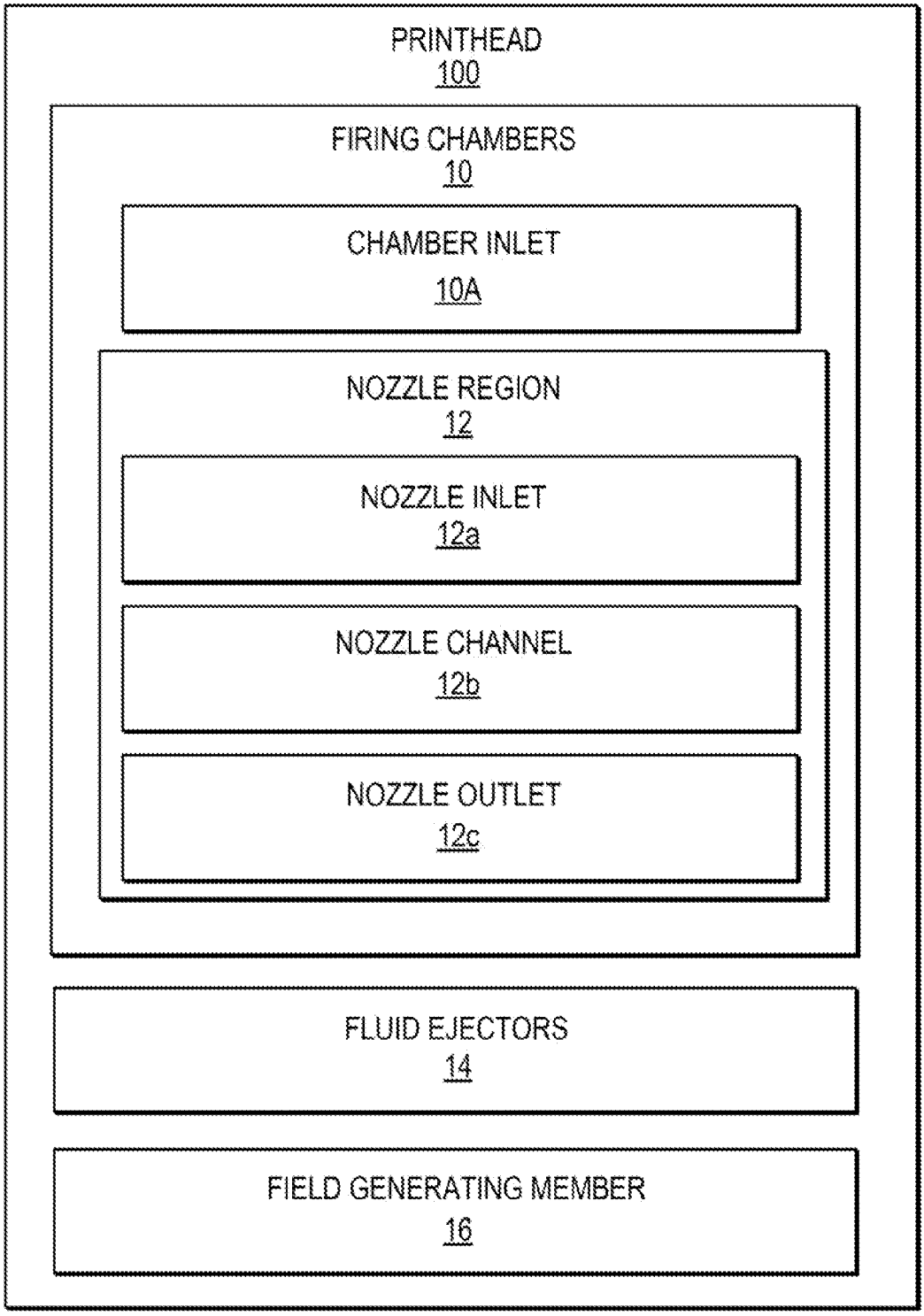
FIG. 1 is a block diagram illustrating a printhead according to an example.

FIG. 1 is a block diagram illustrating a printhead according to an example. Referring to FIG. 1, a printhead 100 includes a plurality of firing chambers 10, a plurality of fluid ejectors 14, and at least one field generating member 16. Each firing chamber 10 includes a chamber inlet 10*a* and a nozzle region 12 to receive printing fluid. The printing fluid includes an ink vehicle having pigments disposed therein. For example, the pigments may be randomly dispersed throughout the ink vehicle. In some examples, the pigments may have a neutral charge. Each nozzle region 12 includes a nozzle inlet 12*a*, a nozzle outlet 12*c*, and a nozzle channel 12*b* disposed between the nozzle inlet 12*a* and the nozzle outlet 12*c*. At least one fluid ejector 14 is disposed in each firing chamber 10 to eject the printing fluid therein through the respective nozzle region 12. That is, a printing fluid drop may be formed and ejected from a corresponding nozzle outlet 12*c*. The fluid ejector 14 may correspond to each nozzle region 12. In some examples, the fluid ejector 14 may include a thermal ejection member, a piezoelectric ejection member, and the like.

Referring to FIG. 1, at least one field generating member 16 generates a non-uniform electric field to apply forces to maintain respective pigments in the ink vehicle of the printing fluid in the nozzle region 12. For example, due to chemical compositions of the printing fluid and/or the atmospheric pressure at the nozzle outlet 12*c*, the pigments may have a tendency to diffuse and move away from the ink vehicle in the nozzle region 12. That is, in some examples, the non-uniform electric field generated by the field generating member 16 may apply forces to act as a barrier 29 to prevent neutrally-charged pigments from moving away from the ink vehicle in the nozzle region 12.

Figure 2:
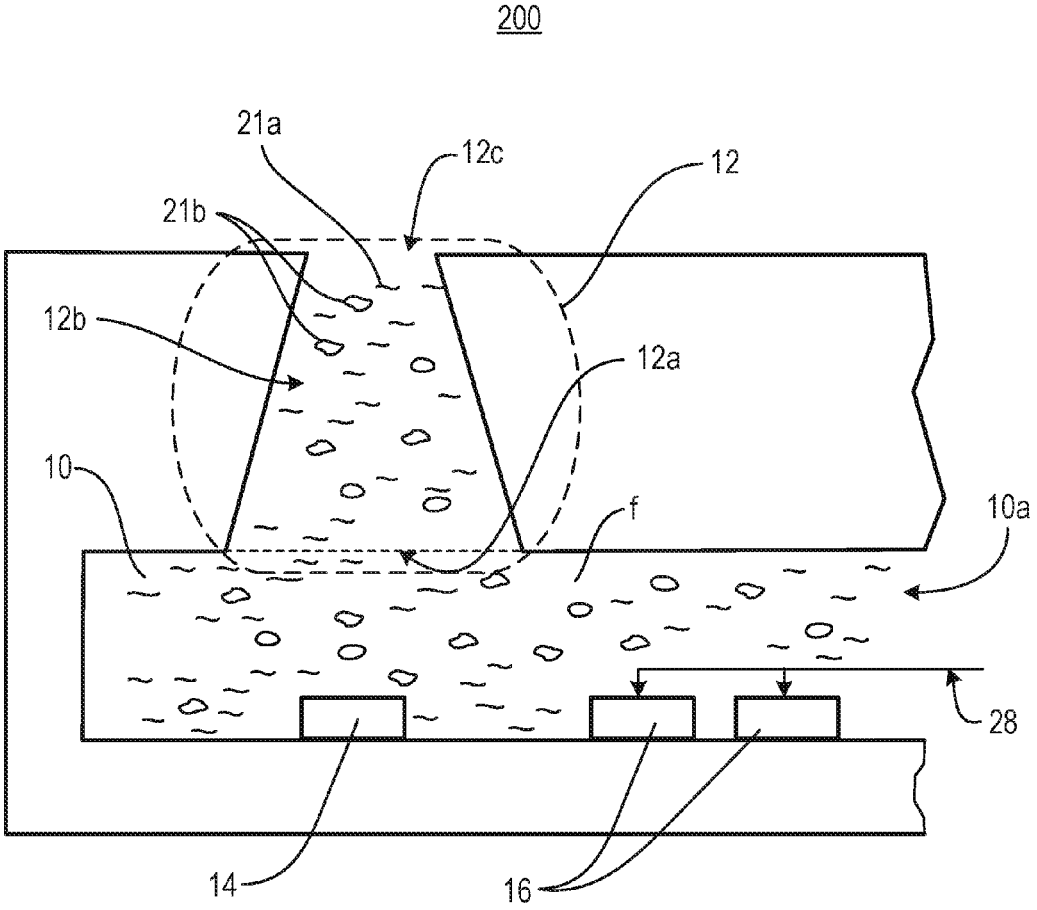
FIG. 2 is a schematic view illustratinga printhead according to an example.
Figure 3:
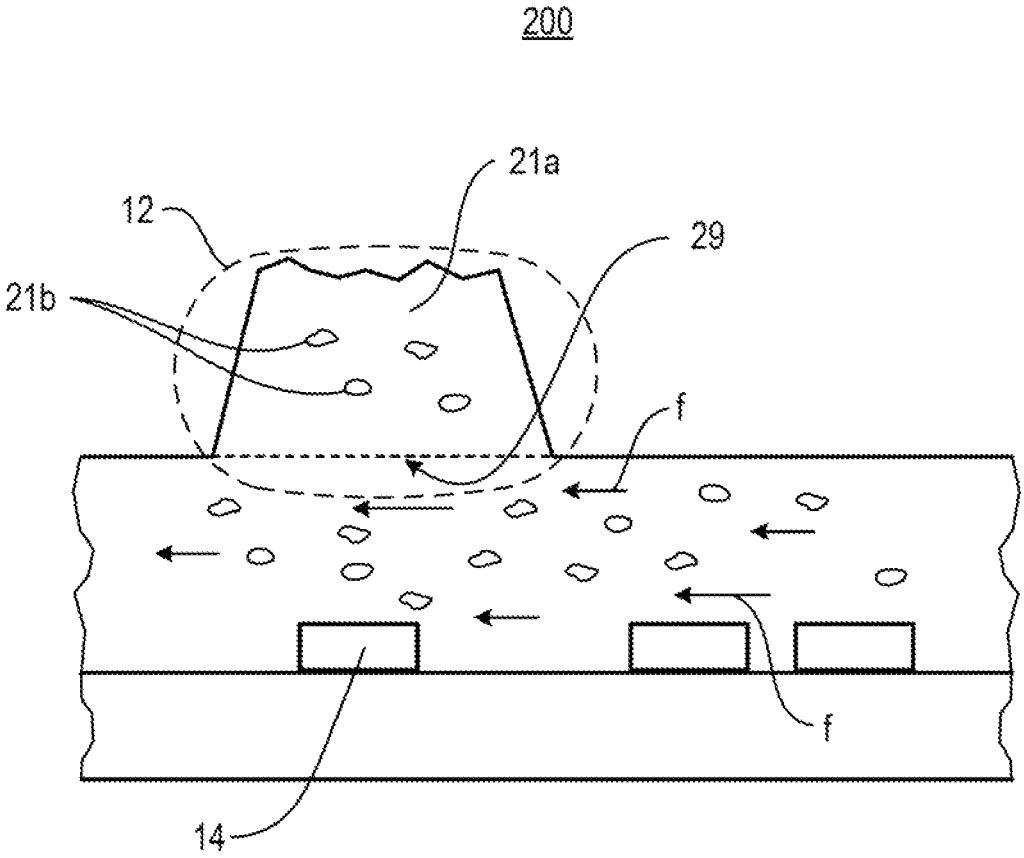
FIG. 3 is an exploded view illustrating a portion of the printhead of FIG. 2 according to an example.
Figure 4:
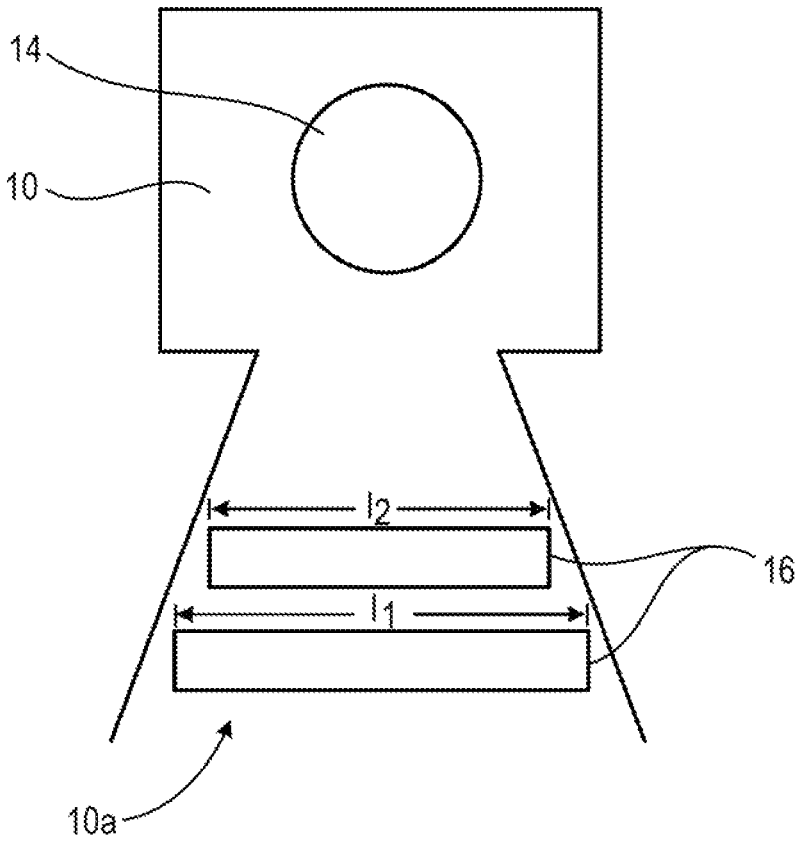
FIG. 4 is a schematic view including field generating members of the printhhead of FIG. 2 according to an example.

FIG. 2 is a schematic view illustrating a printhead according to an example. FIG. 3 is an exploded view illustrating a portion of the printhead of FIG. 2 according to an example. FIG. 4 is a schematic view illustrating field generating members of the printhead of FIG. 2 according to an example. The printhead 200 may include the firing chambers 10, the fluid ejectors 14, and the field generating member 16 as previously discussed with respect to the printhead 100 of FIG. 1. Referring to FIGS. 2-4, in some examples, the field generating member 16 is disposed in the firing chamber 10. For example, the field generating member 16 is disposed proximate to the chamber inlet 10*a*. In some examples, the field generating member 16 may be positioned at or close to the chamber inlet 10*a*. Alternatively, the field generating member 16 may be disposed at or close to the nozzle inlet 12*a*. In some examples, printing fluid may be supplied to the chamber inlet 10*a* from a fluid supply and/or fluid supply channel (not illustrated).

Referring to FIGS. 2-4, in some examples, at least one field generating member 16 may include a plurality of field generating members disposed in the firing chamber 10. For example, the plurality of field generating members 16 may include two field generating members having different sizes from each other as illustrated in FIG. 4. In some examples, the field generating members 16 may have different lengths $l_1$ and $l_2$ from each other. The field generating members 16 may include tantalum, silicon nitride, and the like.

Referring to FIGS. 2-4, in some examples, the non-uniform electric field generated by the at least one field generating member 16 is configured to maintain the respective pigments 21*b* in the ink vehicle 21*a* in the nozzle region 12 prior to ejection of the printing fluid through the respective nozzle outlet 12*c* by a corresponding fluid ejector 14. That is, in some examples, the non-uniform electric field generated by the field generating member 16 may apply forces f to act as a barrier 29 to prevent pigment ink vehicle separation and/or pigments 21*b* having a neutral charge from moving away from the ink vehicle 21*a* in the nozzle region 12 as illustrated in FIG. 3, The pigments 21*b* may include color pigments.

Referring to FIGS. 2-4, in some examples, the non-uniform electric field may be generated in response to a signal 28 received by the field generating member 16. For example, the field generating member 16 may receive a voltage signal having an amplitude of about one volt. The fluid ejector 14 is disposed in each firing chamber 10 may eject the printing fluid therein through the respective nozzle region 12. As printing fluid leaves the printhead by being ejected from the nozzle region 12 by a corresponding fluid ejector 14, a suction is created to enable additional printing fluid to enter the firing chamber 10 through the chamber inlet 10*a* and replace the ejected printing fluid in the nozzle region 12.

Figure 5:
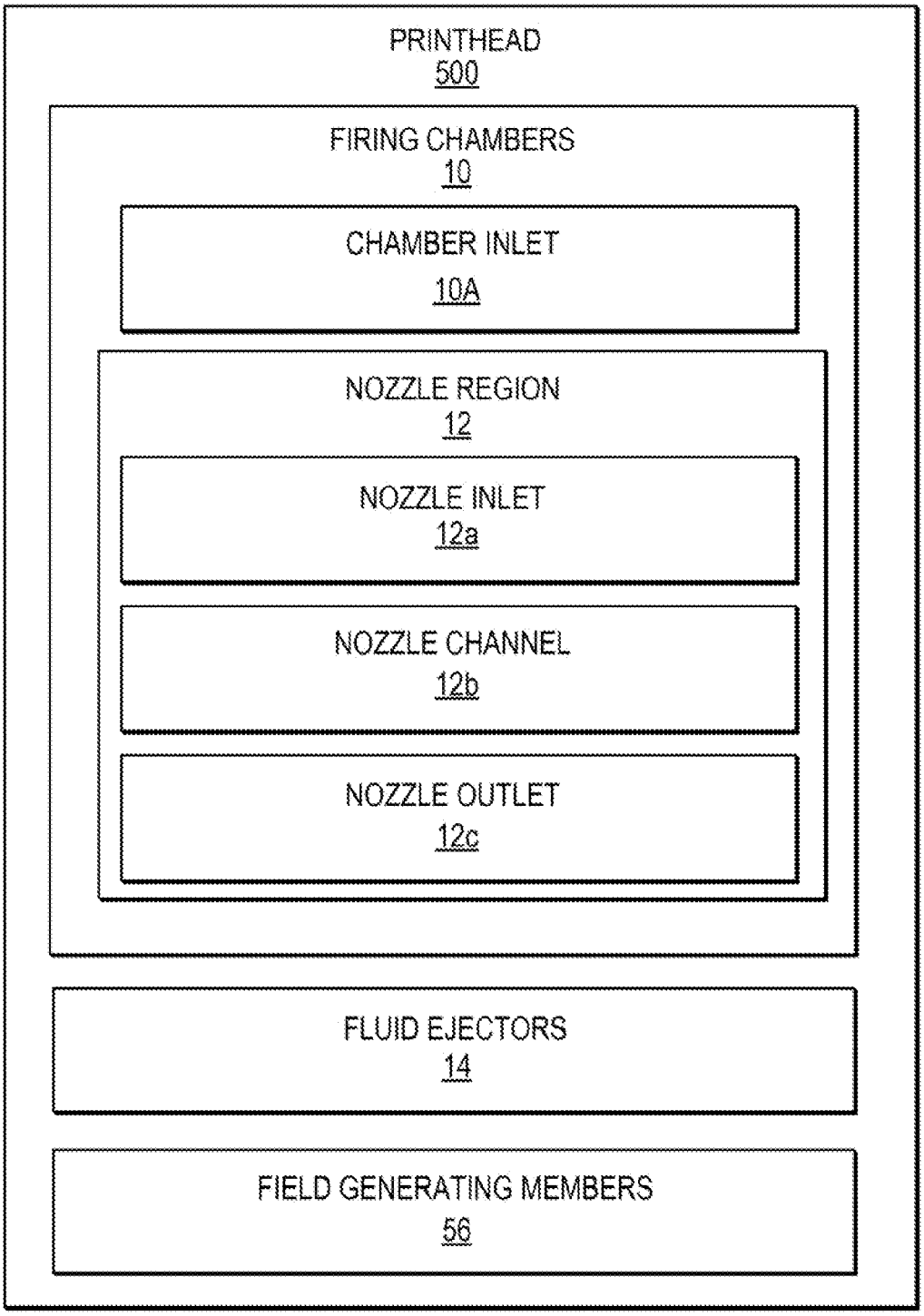
FIG. 5 is a block diagram illustrating a printhead according to an example.

FIG. 5 is a block diagram illustrating a printhead according to an example. The printhead 500 may include a plurality of firing chambers 10 and a plurality of fluid ejectors 14 as previously discussed with respect to the printhead 100 of FIG. 1. Referring to FIG. 5, the firing chambers 10 include chamber inlets 10*a* and nozzle regions 12 to receive printing fluid. The printing fluid includes an ink vehicle having color pigments disposed therein. Each nozzle region 12 includes a nozzle inlet 12*a*, a nozzle outlet 12*c*, and a nozzle channel 12*b* disposed between the nozzle inlet 12*a* and the nozzle outlet 12*c*.

Referring to FIG. 5, at least one fluid ejector 14 is disposed in each firing chamber 10 to eject the printing fluid therein through the respective nozzle region 12. That is, a printing fluid drop may be formed and ejected from a corresponding nozzle outlet 12*c*. In some examples, the fluid ejector 14 may include a thermal ejection member, a piezoelectric ejection member, and the like. The field generating members 56 have different sizes and are disposed in each firing chamber 10. For example, the field generating members 56 may have different lengths from each other. The field generating members 56 generate a non-uniform electric field in response to receiving a signal. The non-uniform electric field maintains respective color pigments in the ink vehicle of the printing fluid in the nozzle region 12 prior to ejection of the printing fluid through the respective nozzle outlet 12*c* by a respective fluid ejector 14.

Referring to FIG. 5, in some examples, the field generating members 16 are disposed proximate to the chamber inlet 10*a*. For example, the field generating members 56 may be positioned at or close to the chamber inlet 10*a*. Alternatively, the field generating members 56 may be disposed at or close to the nozzle inlet 12*a*. The field generating members 56 may include tantalum, silicon nitride, and the like.

Figure 6:
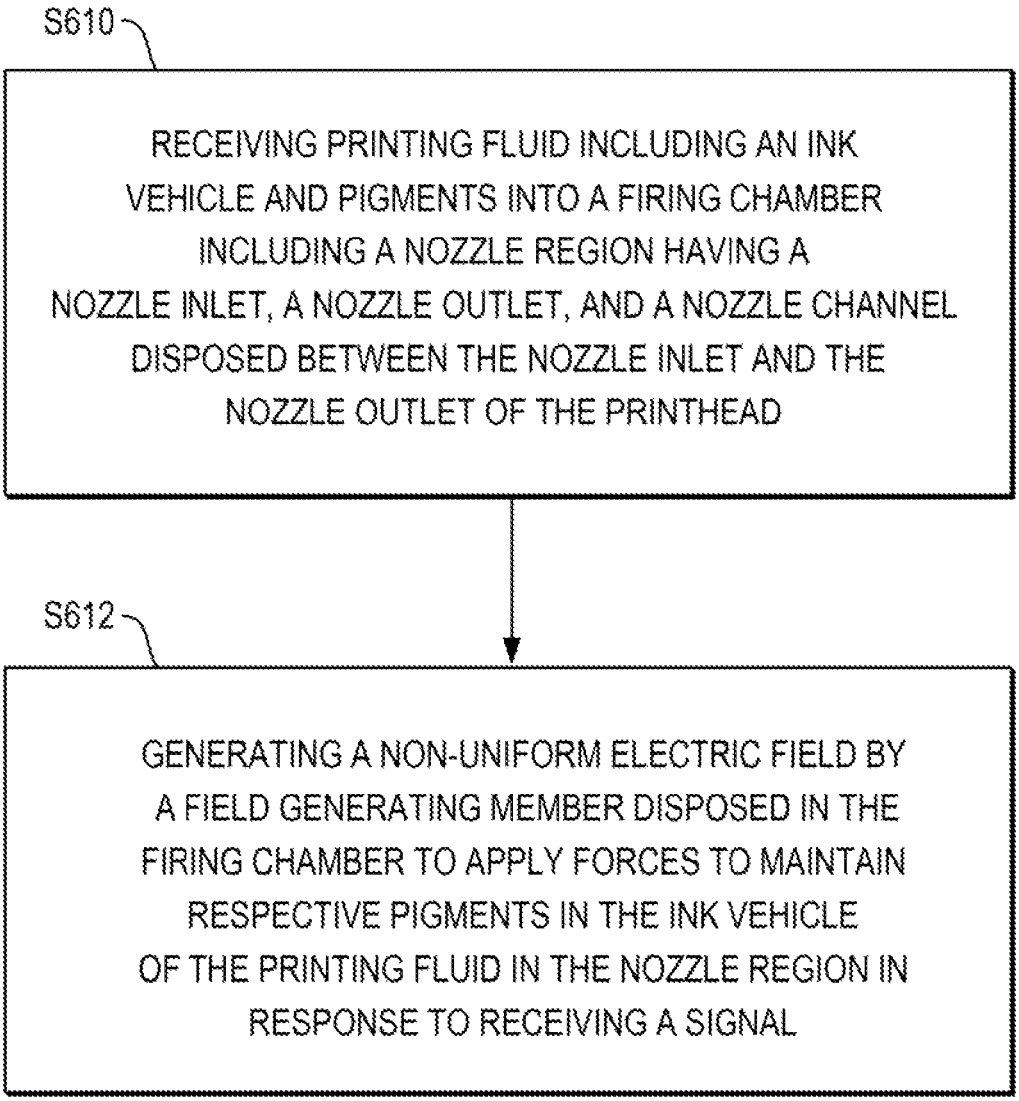
FIG. 6 is a flowchart illustrating a method of operating a printhead according to an example.

FIG. 6 is a flowchart illustrating a method of operating a printhead according to an example. In some examples, the modules and/or assemblies implementing the method may be those described in relation to the printheads 100, 200, and 500 of FIGS. 1-5. Referring to FIG. 6, in block S610, printing fluid including an ink vehicle and pigments is received into a firing chamber including a nozzle region. The nozzle region includes a nozzle inlet, a nozzle outlet, and a nozzle channel disposed between the nozzle inlet and the nozzle outlet of the printhead. The pigments may include color pigments such as color pigments having a neutral charge.

In block S612, a non-uniform electric field is generated by a field generating member disposed in the firing chamber. The field generating member may include tantalum, silicon nitride, and the like. The non-uniform electric field applies forces to maintain respective pigments in the ink vehicle of the printing fluid in the nozzle region in response to receiving a signal. That is, in some examples, the non-uniform electric field generated by the field generating member may apply forces to act as a barrier to prevent pigments having a neutral charge from moving away from the ink vehicle in the nozzle region.

For example, the respective pigments may be maintained In the ink vehicle of the printing fluid in the nozzle region prior to ejection of the printing fluid therein through the nozzle outlet by the fluid ejector. That is, the pigments in the ink vehicle located in the nozzle region may remain therein, rather than diffuse and move away from the nozzle region. Thus, the non-uniform barrier may reduce pigment ink vehicle separation in the printing fluid in the nozzle region. Accordingly, the printing fluid ejected onto the media may include an appropriate amount of pigments. Thus, image quality degradation due to pigment ink vehicle separation may be reduced.

In some examples, the method may also include ejecting the printing fluid in the nozzle region by a fluid ejector disposed in the firing chamber through the nozzle outlet. That is, a fluid ejector may correspond to each nozzle region. As printing fluid is ejected from the nozzle region by the corresponding fluid ejector and leaves the printhead, a suction is created to enable additional printing fluid to enter the firing chamber through the chamber inlet and replace the ejected printing fluid in the nozzle region. In some examples, the fluid ejector may include a thermal ejection member, a piezoelectric ejection member, and the like.

It is to be understood that the flowchart of FIG. 6 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 6 illustrates a specific order of execution, the order of execution may differ from that which is depicted. For example. the order of execution of two or more blocks may be rearranged relative to the order illustrated. Also, two or more blocks illustrated in succession in FIG. 6 may be executed concurrently or with partial concurrence. All such variations are within the scope of the present disclosure.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include" "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art.

Therefore, the scope of the present disclosure is limited only by the elements and limitations as used in the claims.

What is claimed is:

1. A printhead, comprising:

a plurality of firing chambers comprising chamber inlets and nozzle regions to receive printing fluid including an ink vehicle having pigments disposed therein, each nozzle region including a nozzle inlet, a nozzle outlet, and a nozzle channel disposed between the nozzle inlet and the nozzle outlet;

a plurality of fluid ejectors disposed in respective firing chambers to eject the printing fluid through the respective nozzle regions; and a field generating member to generate a non-uniform electric field to apply forces to maintain respective pigments in the ink vehicle of the printing fluid in a first nozzle region of the nozzle regions by reducing separation of the respective pigments from the ink vehicle of the printing fluid in the first nozzle region.

2. The printhead of claim 1, wherein the non-uniform electric field generated by the field generating member is configured to maintain the respective pigments in the ink vehicle in the first nozzle region prior to ejection of the printing fluid through a respective nozzle outlet by a respective fluid ejector.

3. The printhead of claim 1, wherein the field generating member is disposed in a firing chamber adjacent the first nozzle region.

4. The printhead of claim 1, wherein the field generating member is disposed proximate to a chamber inlet.

5. The printhead of claim 1, wherein the field generating member is a first field generating member, and the printhead further comprises:

a second field generating member to cooperate with the first field generating member to generate the non-uniform electric field.

6. The printhead of claim 5, wherein the first and second field generating members have different sizes from each other.

7. The printhead of claim 1, wherein the field generating member comprises tantalum.

8. The printhead of claim 1, wherein the pigments comprise color pigments.

9. The printhead of claim 1, wherein the field generating member is to generate the non-uniform electric field to apply the forces to reduce separation of the respective pigments having a neutral charge from the ink vehicle in the first nozzle region.

10. A printhead, comprising:

a plurality of firing chambers including chamber inlets and nozzle regions to receive printing fluid including an ink vehicle having color pigments disposed therein, each nozzle region including a nozzle inlet, a nozzle outlet, and a nozzle channel disposed between the nozzle inlet and the nozzle outlet;

a plurality of fluid ejectors disposed in respective firing chambers to eject the printing fluid through the respective nozzle regions; and a plurality of field generating members having different sizes from each other disposed in the each respective firing chamber of the firing chambers, each of the field generating members to generate a respective non-uniform electric field in response to receiving a signal to apply forces that reduce separation of respective color pigments from the ink vehicle of the printing fluid in a respective nozzle region prior to ejection of the printing fluid through a respective nozzle outlet by a respective fluid ejector.

11. The printhead of claim 10, wherein each of the field generating members is disposed proximate to the chamber inlet of the respective firing chamber.

12. The printhead of claim 10, wherein the plurality of field generating members comprise tantalum.

13. The printhead of claim 10, wherein each of the field generating members is to generate the respective non-uniform electric field that applies the forces to reduce separation of the respective pigments having a neutral charge from the ink vehicle in the respective nozzle region.

14. A method of operating a printhead, the method comprising:

receiving printing fluid including an ink vehicle and pigments into a firing chamber including a nozzle region having a nozzle inlet, a nozzle outlet, and a nozzle channel disposed between the nozzle inlet and the nozzle outlet of the printhead; and in response to a signal, generating a non-uniform electric field using a field generating member disposed in the firing chamber to apply forces to reduce separation of respective pigments from the ink vehicle of the printing fluid in the nozzle region.

15. The method of claim 14, further comprising:

ejecting the printing fluid in the nozzle region by a fluid ejector disposed in the firing chamber through the nozzle outlet.

16. The method of claim 15, wherein the generating the non-uniform electric field by the field generating member comprises:

maintaining the respective pigments in the ink vehicle of the printing fluid in the nozzle region prior to ejection of the printing fluid therein through the nozzle outlet by the fluid ejector.

17. The method of claim 14, wherein the field generating member comprises tantalum.

18. The method of claim 14, wherein reducing the separation comprises reducing, by the non-uniform electric field, separation of the respective pigments having a neutral charge from the ink vehicle in the nozzle region.

19. The method of claim 14, wherein generating the non-uniform electric field is performed by a plurality of field generating members.

* * * * *